US006225738B1

(12) United States Patent
Kim

(10) Patent No.: US 6,225,738 B1
(45) Date of Patent: May 1, 2001

(54) FIELD EMISSION DEVICE

(75) Inventor: Jong-min Kim, Yongin (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/038,163

(22) Filed: Mar. 11, 1998

(51) Int. Cl.[7] ..... H01J 1/62; H01J 63/04
(52) U.S. Cl. ..... 313/495; 313/496; 313/497
(58) Field of Search ..... 313/495, 496, 313/497; 252/301.04 R, 301.06 S, 301.06 P, 301.4 P

(56) References Cited

U.S. PATENT DOCUMENTS 5,032,316 * 7/1991 Takahashi et al. ..... 252/301.6 S
5,801,485 * 9/1998 Van Veen et al. ..... 313/495
5,906,721 * 5/1999 Bojkov et al. ..... 204/491
5,949,184 * 9/1999 Ohoshi et al. ..... 313/485

* cited by examiner

*Primary Examiner*—Nimeshkumar D. Patel
*Assistant Examiner*—Matthew J. Gerike
(74) *Attorney, Agent, or Firm*—The Law Offices of Eugene M. Lee, PLLC

(57) ABSTRACT

A field emission device by which a color image can be displayed and a method for fabricating the same are provided. The anodes to be doped with the fluorescent film of the same color are connected to each other so that the color fluorescent film can be coated on the anodes of the front surface substrate using the electrophoretic method. The anodes crossing each other are detoured by forming an insulating layer in an area in which the electrodes cross each other. It is possible to obtain a cheap and clean fluorescent film by sequentially forming the fluorescent films of the respective colors by the electrophoretic method. Packaging can be easily performed since the anodes of the front surface substrate on which the fluorescent film is formed can easily contact the external terminals of the rear surface substrate.

2 Claims, 5 Drawing Sheets

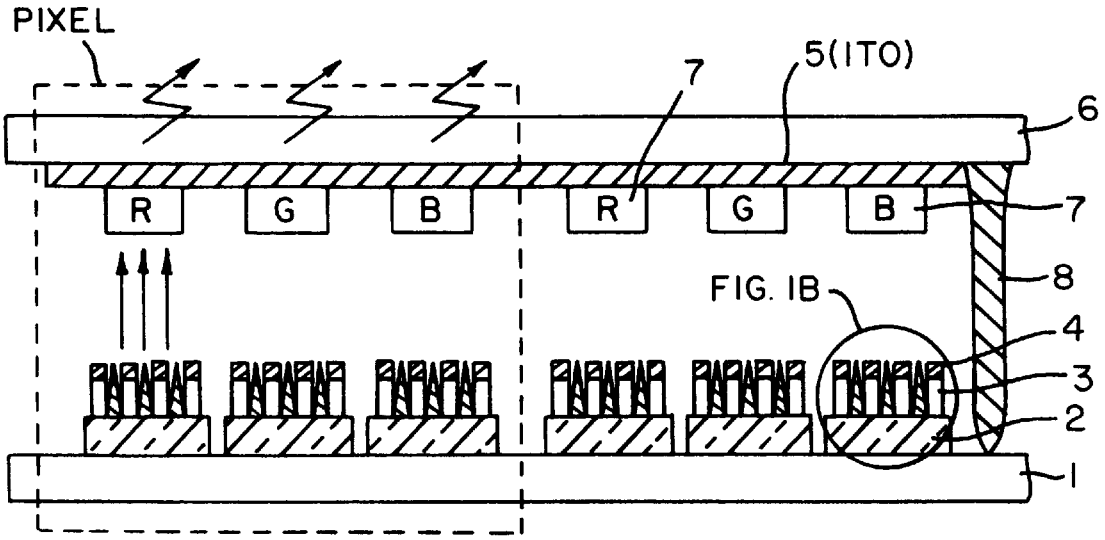
FIG. IA PRIOR ART
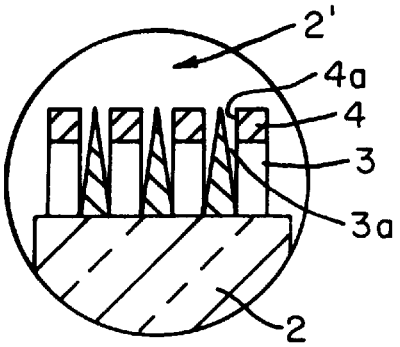
FIG. IB

FIELD EMISSION DEVICE

BACKGROUND OF THE INVENTION

1. Field of the Invention

The present invention relates to a field emission device and a method for fabricating the same.

2. Description of the Related Art

FIG. 1 is a sectional view of a conventional field emission device. As shown in FIG. 1, a plurality of cathodes 2 are formed on a rear surface substrate 1 in the conventional field emission device. A plurality of microtips 2' are formed on the cathodes 2 in an array pattern. The microtips 2' are formed in a throughhole 3*a* of an insulating layer 3 formed on the cathodes 2. Gates 4 having an opening 4*a* corresponding to the throughhole 3*a* are stacked on the insulating layer 3. A front surface substrate 6 supported by spacers 8 spaced from each other by a predetermined distance is provided on the gates 4. A plurality of anodes 5 are formed on the front surface substrate 6 so as to be opposed to the microtips 2'. Red, green, and blue fluorescent films 7 are formed on the anodes 5 in strips. The microtip array of the rear surface substrate is a portion (refer to the portion in a circle in the drawing) corresponding to a cathode of an electron gun of a CRT. The portion coated by a fluorescent film of the front surface substrate is a portion corresponding to an anode formed on the front surface glass of a CRT.

When the microtip array of the field emission device is grounded and a uniform voltage is applied between the gates 4 and the anodes 5, electrons are emitted into a vacuum and arrive at the anodes 5. At this time, the electrons accelerated by the voltage of the anodes 5 collide with a fluorescent film 7 with a predetermined kinetic energy. The kinetic energy of the electrons is transmitted to the fluorescent film 7. The fluorescent film 7 receives the kinetic energy of the electrons and is excited. Accordingly, the fluorescent film 7 emits light. However, as shown in FIG. 1, since the red, green, and blue fluorescent films 7 are formed in parallel, spaced apart from each other by a predetermined distance, the frequency for driving the gates 4 becomes higher when the device is driven by switching the gates 4. Accordingly, signal processing becomes more difficult and the red, green, and blue fluorescent films 7 simultaneously emit light or are extinguished. Namely, the red, green, and blue fluorescent films cannot be driven in a way of emitting light individually. Also, the fluorescent films 7 can be fabricated using PVA-slurry or screen printing. A fluorescent material cannot be coated by an electrophoretic method. Therefore, it is expensive to fabricate the fluorescent film.

SUMMARY OF THE INVENTION

To solve the above problem(s), it is an objective of the present invention to provide a field emission device in which the frequency of a signal for driving gates is lowered and the cost of coating a fluorescent film is reduced by forming anodes so that each of red, green, and blue fluorescent films emit light individually and driving the anodes and switching the gates at the same time.

It is another objective of the present invention to provide a method for fabricating the above-mentioned field emission device.

Accordingly, to achieve the first objective, there is provided a field emission device, comprising a front surface substrate and a rear surface substrate spaced apart from each other by a predetermined distance and arranged to be opposite each other, cathodes formed on the rear surface substrate in strips, a plurality of microtips formed on the cathodes in an array pattern so as to electrically contact the cathodes, an insulating layer formed on the cathodes and the substrate exposing portion so as to have throughholes for holding the plurality of microtips, gates formed on the insulating layer in strips in a direction crossing the cathodes so as to have openings corresponding to the throughholes of the insulating layer, anodes formed on the surface of the front surface substrate corresponding to the rear surface substrate in strips, and fluorescent films coated on the anodes wherein the respective pixel cells are formed by sequentially forming the red, green, and blue fluorescent films on the anodes, each of which is comprised of three, external terminals are formed by the anodes on which the fluorescent film of the same color contact each other in the anodes on which the red, green and blue fluorescent films are formed, and an insulating layer is included in an area in which the anodes cross each other so that a contact wiring for connecting the anodes of an arbitrary color detours the anodes on which a fluorescent film of another color is formed.

In the present invention, a contact line for contacting the external terminals formed on the front surface substrate to the external terminals on the rear surface substrate is further comprised in a vacuum space between the front surface substrate and the rear surface substrate. The contact line is formed of In and Sn in a ratio of 50:50.

To achieve the second objective, there is provided a method for fabricating the field emission device, comprising the steps of (a) forming cathodes, microtips, an insulating layer, and a gate on a rear surface substrate and forming external terminals corresponding to red, green, and blue image signals at one edge, (b) forming anodes in strips on a front surface substrate, contact wirings for contacting anodes to be doped with a fluorescent film of the same color at one edge of anodes, each of which is comprised of three, and external terminals corresponding to the contact wirings, (c) coating red, green, and blue fluorescent films on the anodes by an electrophoretic method, (d) contacting the external terminals of the front surface substrate to the external terminals of the rear surface substrate in a state in which spacers are arranged between the front surface substrate and the rear surface substrate, and (e) sealing the edges of the front surface substrate and the rear surface substrate and vacuumizing the sealed inside.

In the present invention, the step (b) comprises the steps of (b-1) forming an insulating layer on an area in which the anodes cross each other so that a contact line for connecting the anodes on which an fluorescent film of an arbitrary color is to be formed detours anodes on which fluorescent films of other two colors will be formed and (b-2) forming the detouring contact wiring on the insulating layer. The detouring contact wiring is formed by coating the metal paste. In the step (d), the contact lines for contacting the external terminals of the front surface substrate to the external terminals of the rear surface substrate are formed to contain In and Sn in a ratio of 50:50. The step (c) comprises the steps of (c-1) preparing $Y_2O_2S$:Eu 10% $In_2O_3$, ZnS:Cu,Al:10% $In_2O_3$, and ZnS:Ag,Cl,Al:10% $In_2O_3$ as the red fluorescent material, the green fluorescent material, and the blue fluorescent material, (c-2) preparing IPA (500 cc) and 7.5 g $Al(NO_3)_3$+$9H_2O$ (10 cc) as a charger and glycerin(50%)+IPA(50%) as a stabilizer, filling the fluorescent material 50 g+IPA(500 cc)+the charger (10 cc)+the stabilizer (10 cc)+formic acid($CH_2O_2$) in a supersonic wave container, and stirring the mixture for 40 minutes, (c-3) installing an Al electrode plate and the front surface plate in the container, controlling the distance between the Al electrode plate and the front surface substrate to be 3–5 cm, applying a bias voltage controlled to be 100–150V to the arbitrary external terminal, and attaching the fluorescent material to the anodes for 3–8 seconds, and (c-4) taking the front surface substrate doped with the fluorescent film from the container and drying the same, wherein the above steps are repeated three times, changing the fluorescent materials in the step (c-2) and the external terminals in the step (c-3). In the step (c-3), the height of the solution in the container is preferably 3–3.5 cm. The step of controlling the conductivity of a plating solution by putting formic acid of not more than 1 ml to the mixture and stirring the mixture for 40 minutes is further comprised after the step (c-2). The step of putting the plating solution in a supersonic wave container, stirring the plating solution, and adding 1–2 cc of the charger to the mixture when the viscosity of the solution is weak is further comprised after the step of controlling the conductivity of the plating solution.

BRIEF DESCRIPTION OF THE DRAWING(S)

The above objectives and advantages of the present invention will become more apparent by describing in detail a preferred embodiment thereof with reference to the attached drawings in which:

FIG. 1 is a sectional view of a conventional field emission device;

DESCRIPTION OF THE PREFERRED EMBODIMENT(S)

Hereinafter, a field emission device according to the present invention and a method for fabricating the same will be described with reference to the attached drawings.

Figure 2A:
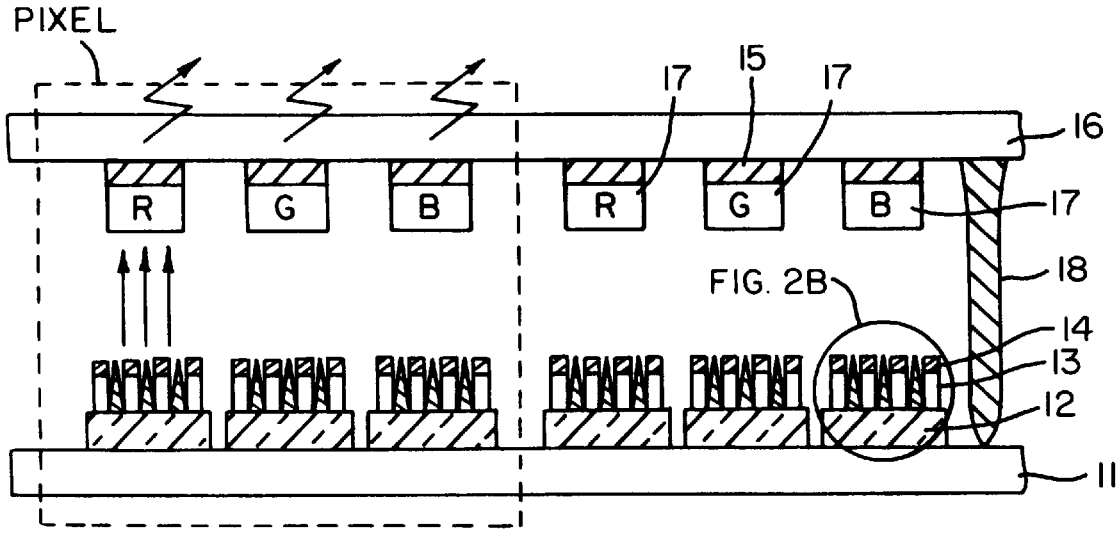
FIG. 2 is a sectional view of a field emission device according to the present invention.
Figure 2B:
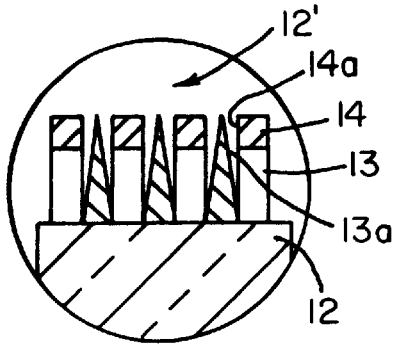

FIG. 2 is a sectional view of a field emission device according to the present invention. As shown in FIG. 2, the basic structure of the field emission device according to the present invention is almost identical to that of the conventional field emission device shown in FIG. 1. The field emission device according to the present invention is different from the conventional field emission device in that fluorescent films 17 are coated in parallel on anodes 15, in strips like the ITO anodes 15. The structure in which the anodes are arranged will be described as follows with reference to FIG. 3.

Figure 4:
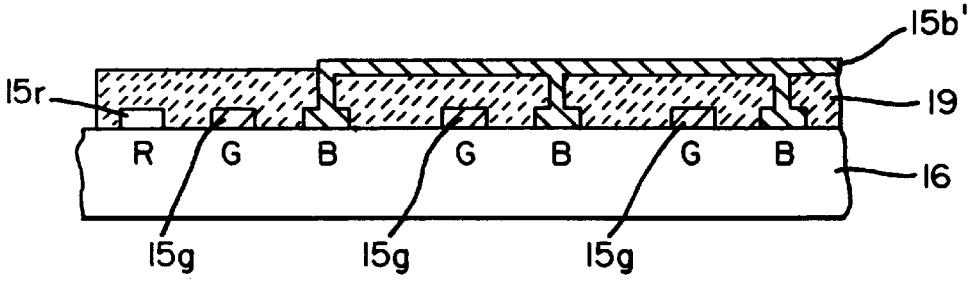
FIG. 4 is a sectional view taken along the line A—A' of FIG. 3.

Anodes 15*r*, 15*g*, and 15*b* on which the fluorescent films of the same color are formed, are wired and are connected to external terminals 15R, 15G, and 15B. Here, the anodes 15*r* and the anodes 15*g* are wired without crossing each other and are respectively connected to the external terminals 15R and 15G. However, the anodes 15*b* cannot be connected to the external terminal 15B unless the anodes 15*b* and the anodes 15*g* cross each other. Therefore, as shown in FIG. 4. an insulating layer 19 is formed on an area in which the anodes 15*b* and the anodes 15*g* cross each other so that a contact line of the anodes 15*b* detours in the cross area. The detour contact line of the anodes 15*b* is formed by coating metal paste on the insulating layer 19. The red, green, and blue fluorescent films are formed on the connected anodes 15*r*, 15*g*, and 15*b* by an electrophoretic method. A method for coating a fluorescent film by the electrophoretic method will be described later.

Figure 5:
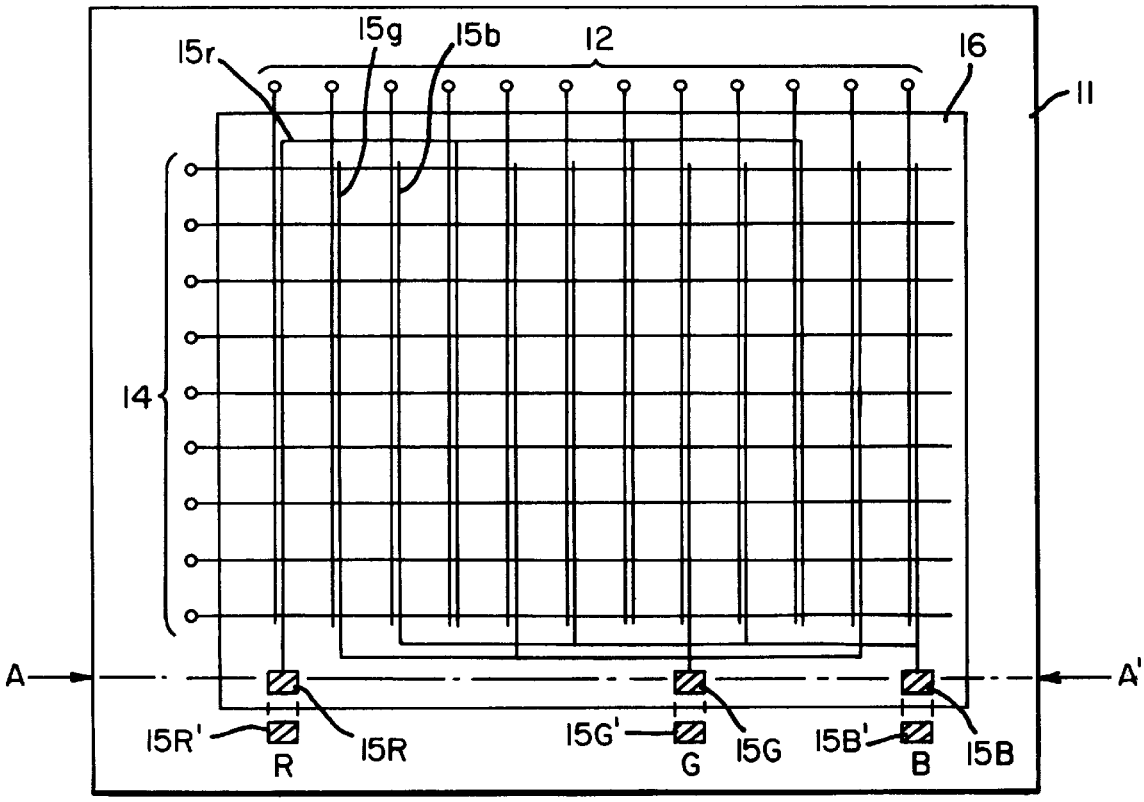
FIG. 5 is a plan view for describing the arrangement of electrodes formed on the front surface and rear surface substrates of the field emission device of FIG. 2.
Figure 6:
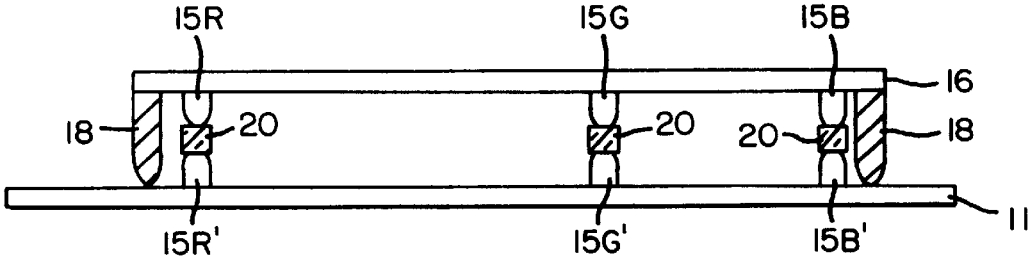
FIG. 6 is a sectional view taken along the line A—A' of FIG. 5.

Also, the field emission device according to the present invention is different from the conventional one in that the external terminals 15R, 15G, and 15B formed on a front surface substrate 16 are combined with external terminals 15R', 15G', and 15B' of a rear surface substrate 11, as shown in FIG. 5. Namely, the external terminals 15R, 15G, and 15B of the front surface substrate 16 are combined with the external terminals 15R', 15G', and 15B' of the rear surface substrate 11 by a contact line 20 in which In and Sn are included in a ratio of 50:50, as shown in FIG. 6. The thickness of the contact line 20 is appropriately controlled according to the height of a spacer 18 for maintaining a distance between the front surface substrate 16 and the rear surface substrate 11.

A method for fabricating the field emission device according to the present invention having the above structure will be described as follows.

As shown in FIG. 2, cathodes 12, microtips 12', an insulating layer 13, and a gate 14 are formed on the rear surface substrate 11. Then, the external terminals 15R', 15G', and 15B' shown in FIG. 5 are formed (step a).

Figure 3:
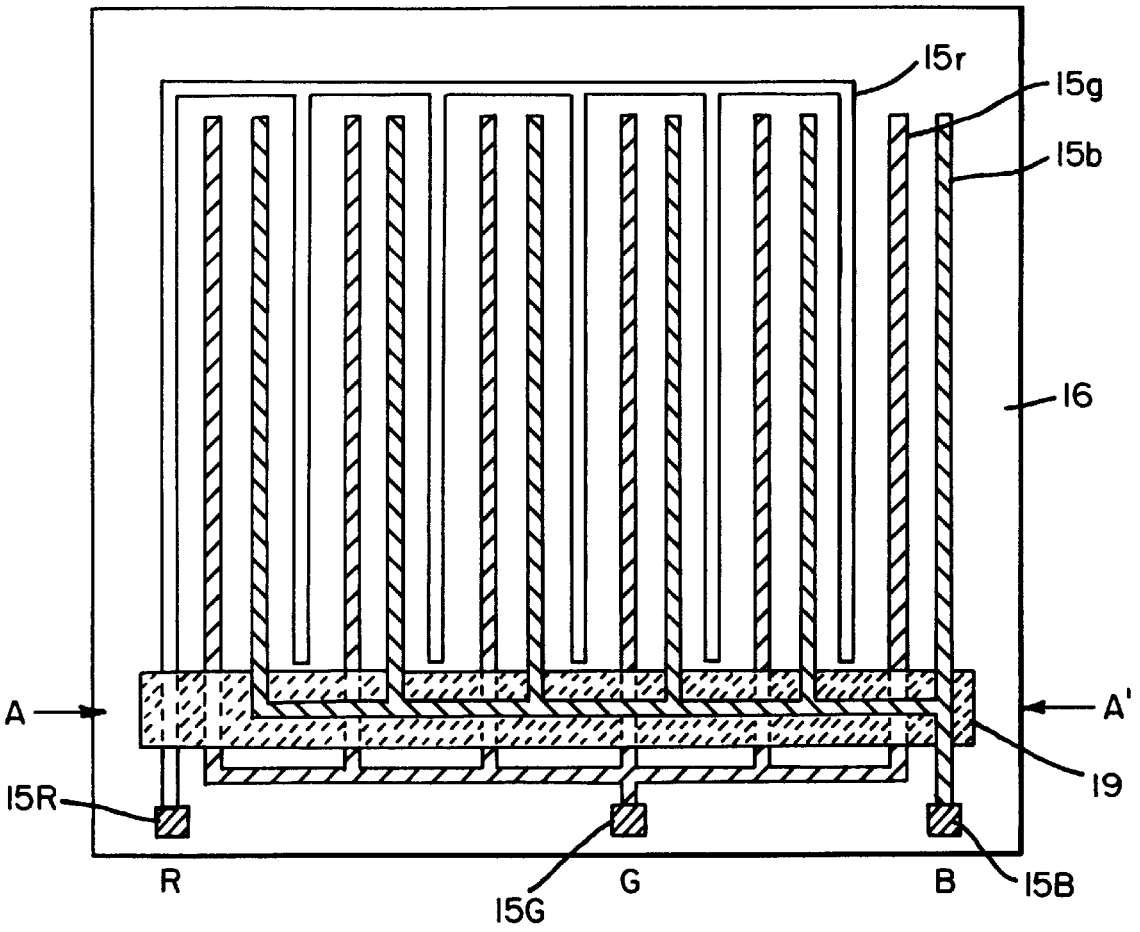
FIG. 3 is a plan view showing red, green, and blue anode patterns of the front surface substrate of the field emission device of FIG. 2.

Then, the anodes 15*r*, 15*g*, and 15*b* in strips are formed on the front surface substrate 16. As shown in FIG. 3, the external terminals 15R, 15G, and 15B are formed at one edge of the front surface substrate 16 (step b). The anodes to be doped with the fluorescent film of the same color are contacted to each other and are connected the external terminals. The step a and the step b may be performed in reverse order.

As shown in FIG. 2, red, green, and blue fluorescent films 17 are coated on the anodes 15 by the electrophoretic method (step c).

In the step c, the red, green, and blue fluorescent films are sequentially formed on the anodes 15*r*, 15*g*, and 15*b*, each of which is comprised of three. As shown in FIG. 3, the anodes on which the fluorescent film of the same color will be formed, contact each other and are connected to the external terminals 15R, 15G, and 15B. At this time, a contact wiring 15*b*' is formed as shown in FIG. 4 by forming an insulating layer 19 on an area in which the anode 15*b* and the anodes 15*g* cross each other so that the contact line for connecting the anodes 15*b* to be doped with a blue (an arbitrary color) fluorescent film detours the anodes 15*g* to be doped with a green (another color) fluorescent film and by coating the metal paste on the insulating layer 19.

The external terminals 15R, 15G, and 15B of the front surface substrate 16 and the external terminals 15R', 15G' and 15B' of the rear surface substrate 11 conductively contact each other under vacuum in a state in which the spacers 18 are arranged as shown in FIG. 6 between the front surface substrate 16 and the rear surface substrate 11. At this time, the contact lines 20 of FIG. 6 for contacting the external terminals 15R, 15G, and 15B of the front surface substrate 16 to the external terminals 15R', 15G', and 15B' of the rear surface substrate 11 are formed to contain In and Sn in a ratio of 50:50.

A device is completed by sealing the edges of the front surface substrate 16 and the rear surface substrate 11 and vacuuming the sealed inside (step e).

In the above-mentioned fabrication method, the step c which may be referred to as the most important process will be described with reference to the apparatus of FIG. 7.

Figure 7:
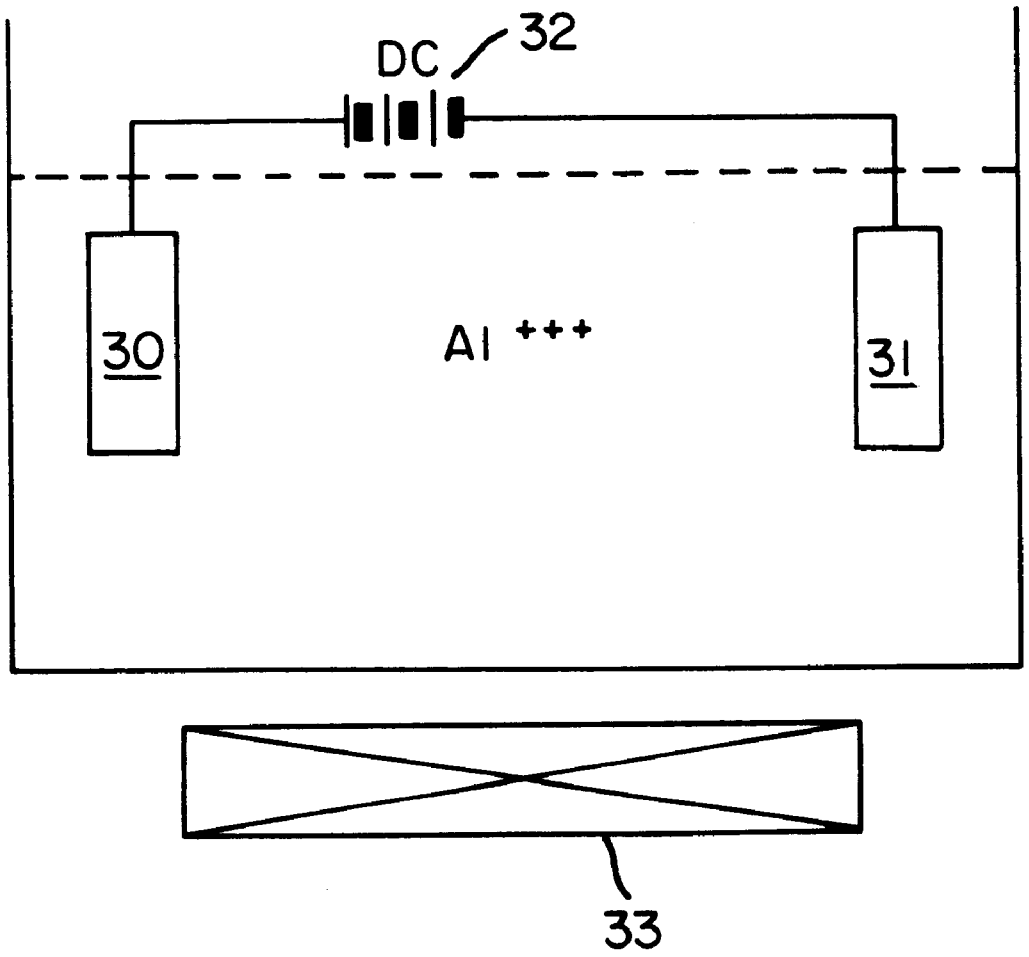
FIG. 7 is a sectional view of an apparatus for coating the fluorescent film of the field emission device according to the present invention.

When the process of coating the red fluorescent film by the electrophoretic method is performed by contacting the external terminal 15R of the front surface substrate 16 to which the anodes are wired, as shown in FIG. 3, to the cathode of a DC power source 32, as shown in FIG. 7, and by contacting an Al electrode plate 30 to the anode of the DC power source 32, a fluorescent material absorbs $Al^{+++}$ ion and flows to and is attached to the anodes of a front surface substrate 31 contacting to the cathode of the power source 32. Reference numeral 33 denotes a magnetic vibrator. After the process of coating the red fluorescent film, the red fluorescent film is dried by taking the front surface substrate out of a container. The process of coating the fluorescent film is completed by sequentially performing the process of coating the green fluorescent film and the process of coating the blue fluorescent film by the above method. The processes of coating the red, green, and blue fluorescent films can be performed in any order.

Also, the order of the processes of coating the fluorescent films is as follows.

$Y_2O_2S$:Eu:10% $In_2O_3$, ZnS:Cu,Al:10% $In_2O_3$, and ZnS:Ag,Cl,Al:10% $In_2O_3$ are prepared as the red fluorescent material, the green fluorescent material, and the blue fluorescent material (step c-1). Other than these, 7.5 g $Al(NO_3)_3+9H_2O$ (10 cc) is prepared as IPA(500 cc)+solution"A"(charger). Glycerin(50%)+IPA(50%) (100 cc) is prepared as a solution "B" (stabilizer). The fluorescent material 50 g+IPA(500 cc)+the solution "A" (10 cc)+the solution "B" (10 cc)+formic acid($CH_2O_2$) is filled in a supersonic wave container and is stirred for 40 minutes (step c-2). At this time, the height of the solution in the container is preferably 3–3.5 cm. The conductivity of the solution is controlled by adding the 6 drops of formic acid to the above mixture and by stirring the mixture for 40 minutes. A desired amount of such a plating solution is prepared.

The plating solution is put in the supersonic waves and is stirred before performing the process of coating the fluorescent film. When the viscosity of the plating solution is weak, 1–2 cc of the solution "A" is added as a charger.

As shown in FIG. 7 the distance between the Al electrode plate 30 and the front surface substrate 31 is controlled to be 3–5 cm. A bias voltage controlled to be 100–150V is applied to an arbitrary external terminal so that the fluorescent material is attached to the selected anodes on the front surface substrate 31 for 3–8 seconds (step c-3). By doing so, the fluorescent material absorbs the $Al^{+++}$ ion and flows to and then, is attached to the anodes of the front surface substrate 31 contacting the cathode of the power source 32.

When the process of coating the fluorescent film of one color is completed, the coated fluorescent film is dried by taking the front surface substrate from the container (step c-4).

As mentioned above, the anodes to be doped with the fluorescent film of the same color are connected to each other so that the color fluorescent film can be coated on the anodes of the front surface substrate using the electrophoretic method. The anodes crossing each other are detoured by forming an insulating layer in an area in which the electrodes cross each other. It is possible to obtain a cheap and clean fluorescent film by sequentially forming the fluorescent films of the respective colors by the electrophoretic method. Packaging can be easily performed since the anodes of the front surface substrate on which the fluorescent film is formed can easily contact the external terminals of the rear surface substrate.

What is claimed is:

1. A field emission device, comprising:

a front surface substrate and a rear surface substrate disposed in a vacuum opposedly spaced apart from each other by a predetermined distance;

cathodes formed in strips on the rear surface substrate;

a plurality of microtips formed on the cathodes in an array pattern and electrically connected to the cathodes;

a first insulating layer formed on the cathodes having throughholes to the cathodes for holding the plurality of the microtips;

gates formed in strips on the first insulating layer in a direction crossing the cathodes maintaining the throughholes of the first insulating layer;

anodes arranged into three groups formed in strips on the surface of the front surface substrate;

contact wiring connecting the anodes within each group;

external terminals corresponding to the groups of cathodes formed on the rear surface substrate;

contact lines formed from a mixture of In and Sn in a ratio of 50:50 connecting the external terminals on the front surface to corresponding external terminals on the rear surface; and red, green, blue fluorescent films with a different color being coated on each group of anodes, wherein respective pixel cells are formed by sequentially forming a red, green, and blue fluorescent films on the abodes, each of which is comprised of three anodes, and a second insulating layer is included in an area in which the anodes cross each other, so that the contact wiring of one group does not contact that of another group.

2. The field emission device of claim 1, wherein the contact wiring is formed by coating a metal paste on the insulating layer.

* * * * *

UNITED STATES PATENT AND TRADEMARK OFFICE

CERTIFICATE OF CORRECTION

PATENT NO. : 6,225,738 B1
DATED : May 1, 2001
INVENTOR(S) : Jong-min Kim

It is certified that error appears in the above-identified patent and that said Letters Patent is hereby corrected as shown below:

Title page,
Item [73], should read as follows:

-- [73] Assignee: Samsung Display Devices Co., Ltd. --.

Signed and Sealed this

Eighteenth Day of February, 2003

JAMES E. ROGAN
*Director of the United States Patent and Trademark Office*